US005917458A

United States Patent [19]

Ho et al.

[11] Patent Number: 5,917,458

[45] Date of Patent: Jun. 29, 1999

[54] FREQUENCY SELECTIVE SURFACE INTEGRATED ANTENNA SYSTEM

[75] Inventors: Thinh Q. Ho, Anaheim; James C. Logan; John W. Rockway, both of San Diego, all of Calif.

[73] Assignee: The United States of America as represented by the Secretary of the Navy, Washington, D.C.

[21] Appl. No.: 08/525,802

[22] Filed: Sep. 8, 1995

[51] Int. Cl.[6] ..... H01Q 15/02; H01Q 15/24

[52] U.S. Cl. ..... 343/909; 343/769; 343/795

[58] Field of Search ..... 343/909, 770, 343/771, 767, 769, 793, 795; H01Q 15/02, 15/24

[56] References Cited

U.S. PATENT DOCUMENTS

| | | | |
|---|---|---|---|
| 3,761,937 | 9/1973 | Tricoles et al. | 343/770 |
| 3,842,421 | 10/1974 | Rootsey et al. | 343/909 |
| 4,513,293 | 4/1985 | Stephens | 343/840 |
| 4,656,487 | 4/1987 | Sureau et al. | 343/909 |
| 4,743,919 | 5/1988 | Chang et al. | 343/914 |
| 4,785,310 | 11/1988 | Rosen | 343/909 |
| 4,814,785 | 3/1989 | Wu | 343/909 |
| 4,816,835 | 3/1989 | Abiko et al. | 343/700 MS |
| 4,851,858 | 7/1989 | Frisch | 343/779 |
| 4,899,164 | 2/1990 | McGrath | 343/754 |
| 4,929,959 | 5/1990 | Sorbello et al. | 343/700 MS |
| 5,130,718 | 7/1992 | Wu et al. | 343/781 CA |
| 5,160,936 | 11/1992 | Braun et al. | 343/725 |
| 5,208,603 | 5/1993 | Yee | 343/909 |
| 5,311,202 | 5/1994 | Popp et al. | 343/909 |
| 5,353,038 | 10/1994 | Osborne et al. | 343/767 |
| 5,528,249 | 6/1996 | Gafford et al. | 343/909 |
| 5,554,999 | 9/1996 | Gupta et al. | 343/909 |

*Primary Examiner*—Hoanganh T. Le
*Attorney, Agent, or Firm*—Harvey Fendelman; Peter A. Lipovsky; Michael A. Kagan

[57] ABSTRACT

A frequency selective surface integrated antenna is provided which comprises a frequency selective surface, including an electrically non-conductive substrate and an electrically conductive layer, mounted to the substrate and having a pattern of apertures; and an antenna integrated in the frequency selective surface.

3 Claims, 8 Drawing Sheets

FREQUENCY SELECTIVE SURFACE INTEGRATED ANTENNA SYSTEM

The present invention relates to frequency selective surfaces, and more particularly, to a frequency selective surface which incorporates an antenna structure.

BACKGROUND OF THE INVENTION

Frequency selective surfaces are used as filters through which electromagnetic energy within a specific frequency range may be propagated. Frequency selective surfaces generally consist of an electrically conductive layer in which patterns of apertures are formed. The electrically conductive layer is usually supported by a dielectric substrate. The shapes of the apertures may includes squares, circles, crosses, concentric rings, and the like.

Radomes are enclosures which protect antennas from the environment and may incorporate frequency selective surfaces. In the past, the antenna and the radome have been constructed as separate entities to perform their separate functions. However, a radome has a finite volume, thereby limiting the number of antennas which can be located within the radome. The communication demands on seagoing vessels generally require a separate antenna for each type of communication system. Therefore, the antennas must all compete for space within a radome. The antenna systems and the radome may be referred to as a radome-antenna system. A need exists for a radome-antenna system which uses space more efficiently than present day systems, as for example, by reducing the volume requirements of a radome without incurring an attendant loss of antenna performance function, or by increasing the number of antennas in the radome-antenna system.

SUMMARY OF THE INVENTION

The present invention provides a frequency selective surface integrated antenna which comprises a frequency selective surface, including an electrically non-conductive substrate and an electrically conductive layer, mounted to the substrate and having a pattern of apertures; and an antenna integrated in the frequency selective surface. Such integrated antennas may include dipole, bow-tie, and/or circular patch antennas.

An important advantage of the invention is that antennas and a frequency selective surface may be incorporated into a single structure. The invention may be used as an element of a radome, thereby conserving space within the radome compared to the space requirements of systems in which the radome and antennas are separate structures.

BRIEF DESCRIPTION OF THE FIGURES

Throughout the several views, like elements are referenced with like reference numerals.

DESCRIPTION OF THE PREFERRED EMBODIMENT

The present invention provides a frequency selective surface integrated antenna system comprising one or more antennas incorporated into a frequency selective surface. The system may be used to construct radomes so that the limited volume enclosed by the radome need not be wasted sheltering antennas which may more advantageously be integrated into a frequency selective surface.

Figure 1:
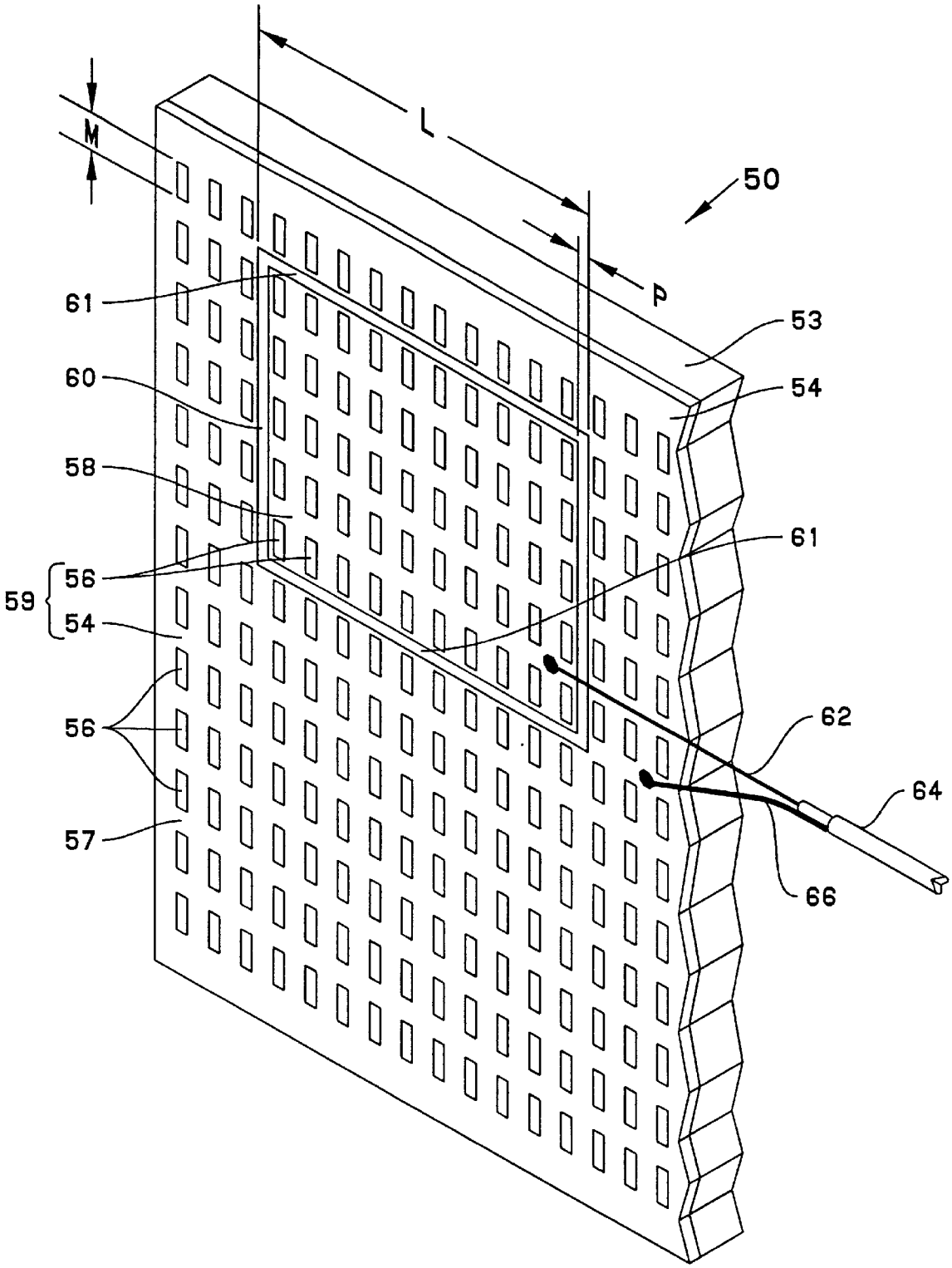
FIG. 1 shows a three-quarter view of a frequency selective surface integrated antenna embodying various features of the present invention.

Referring now to FIG. 1, there is shown a radio frequency selective surface (FSS) integrated antenna system 50, comprising a conductive layer 54 mounted to an electrically non-conductive substrate 53 such as HT-70 PVC foam. The conductive layer 54 may be formed of copper or a copper alloy, and have a thickness of about 0.005 inches. The conductive layer 54 may be bonded to the substrate 53 using NB102 adhesive applied at about 0.060 lbs./in$^2$. A pattern of apertures 56 is formed in the conductive layer 54, preferably by standard photolithographic processes, allowing the substrate 53 to be exposed through the conductive layer 54. The apertures 56 formed in the conductive layer 54 provides a radio frequency selective (FSS) surface 59. The length, M, of each aperture preferably may be about $\lambda_A/2$, where $\lambda_A$ represents the center wavelength of electromagnetic energy for which the radio frequency selective surface 59 is designed to be transparent. A slotline 60 formed in the conductive layer 54 forms a perimeter which electrically isolates an area of the conductive layer 54, referred to as a radio frequency (RF) resonator (i.e. antenna) 58, from a ground plane region 57 of the conductive layer 54.

Slotline 60 may be defined as a channel having a width, P, which may be formed using photolithographic techniques to expose the underlying electrically non-conductive substrate 53, where preferably, $P<\lambda_A/10$. By way of example, the slotline shown in FIG. 1 provides the resonator 58 with a rectangular perimeter with parallel legs 61 having a length, L, which may be about $\lambda_D/2$, where $\lambda_D$ represents the center wavelength of the electromagnetic radiation which is to be radiated and/or detected by the resonator 58. The resonator 58 may be fed by the center conductor 62 of coaxial cable 64 which includes shielding 66 grounded to ground plane region 57. The single resonator 58, shown in FIG. 1, and ground plane region 57 provide an antenna incorporated into the frequency selective surface integrated antenna 50. The scope of the invention may be generalized to include any integral number of resonators configured into various shapes such as rectangles, triangles, circles, and ovals.

Figure 2:
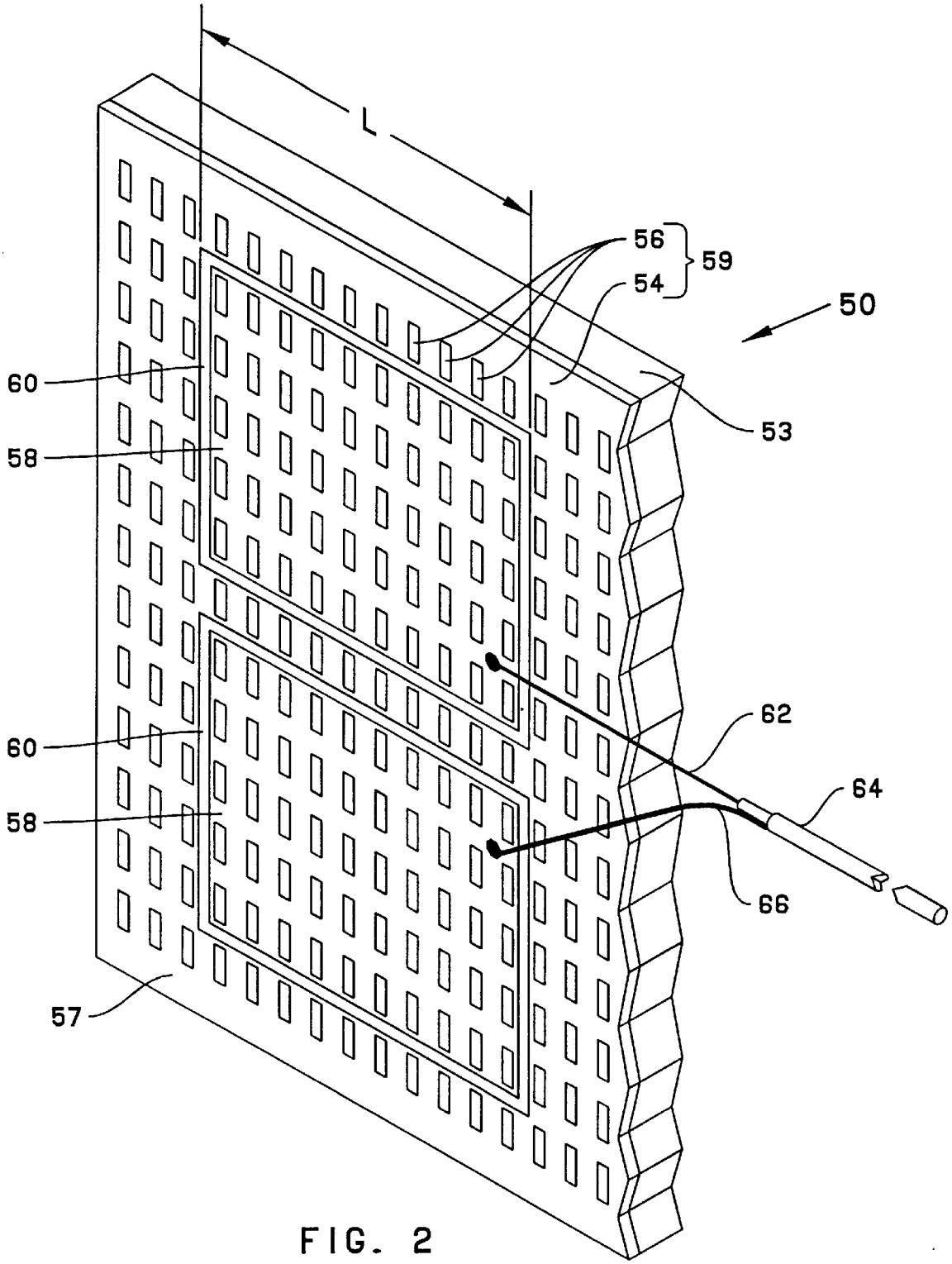
FIG. 2 shows a dipole-antenna formed in the conductive lay of a frequency selective surface.

FIG. 2 illustrates an embodiment of the (FSS) integrated antenna 50 which includes two rectangularly shaped resonator areas 58 to provide the antenna system 50 with a dipole-antenna integrated in the frequency selective surface 59. One of the resonators 58 may be fed by center conductor 62 of coaxial cable 64. The other resonator 58 is electrically connected to the shielding 66 of the coaxial cable 64.

Figure 3:
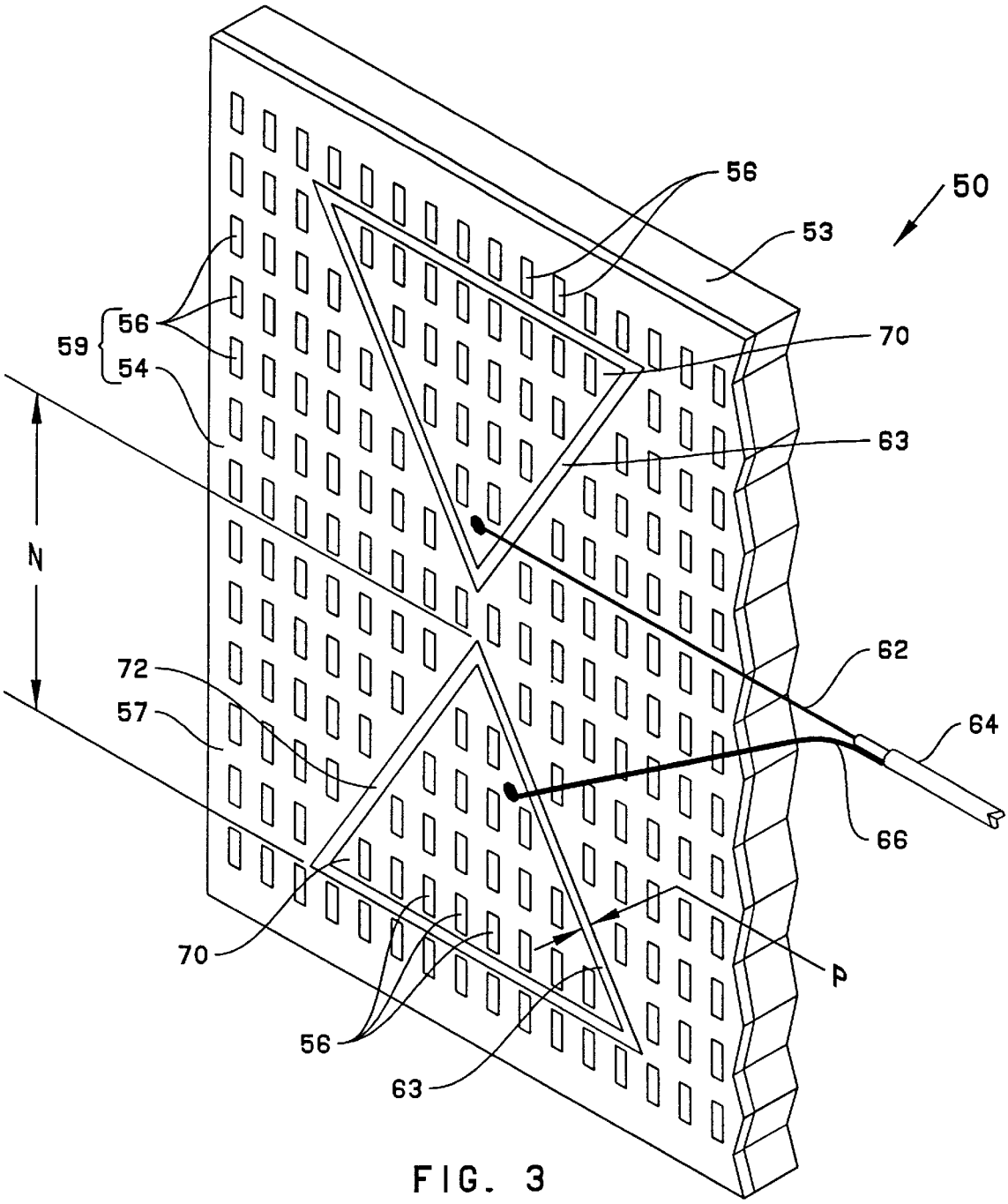
FIG. 3 shows a bow-tie antenna formed in the conductive layer of a frequency selective surface.

FIG. 3, shows an embodiment of antenna system 50 which includes shows a bow-tie antenna integrated in the conductive layer 54 of frequency selective surface 59. The bow-tie antenna includes opposed triangular resonators 70 having triangle shaped perimeters defined by slotlines 63. In the preferred embodiment, the slotlines 63 each define an equilateral triangle having an altitude N of about $\lambda_D/4$. The resonators 70 are electrically isolated from ground plane 57 by triangular shaped slotlines 72. By way of example, one resonator 70 may be fed by center conductor 62 of coaxial cable 64, and the other resonator 70 may be electrically connected to the shielding 66 of the coaxial cable 64.

Figure 4:
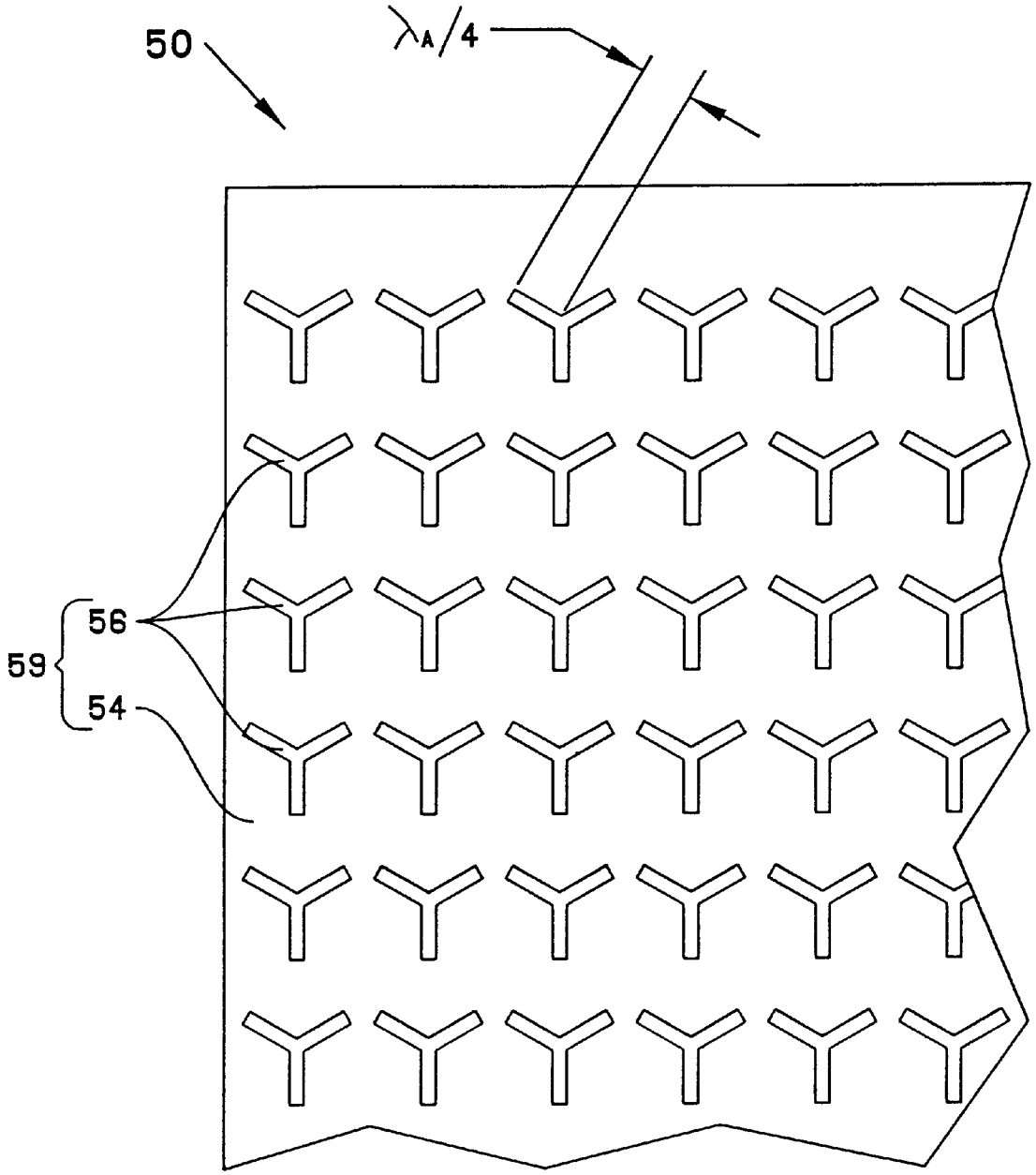
FIG. 4 shows Y-shaped apertures formed in a frequency selective surface.
Figure 5:
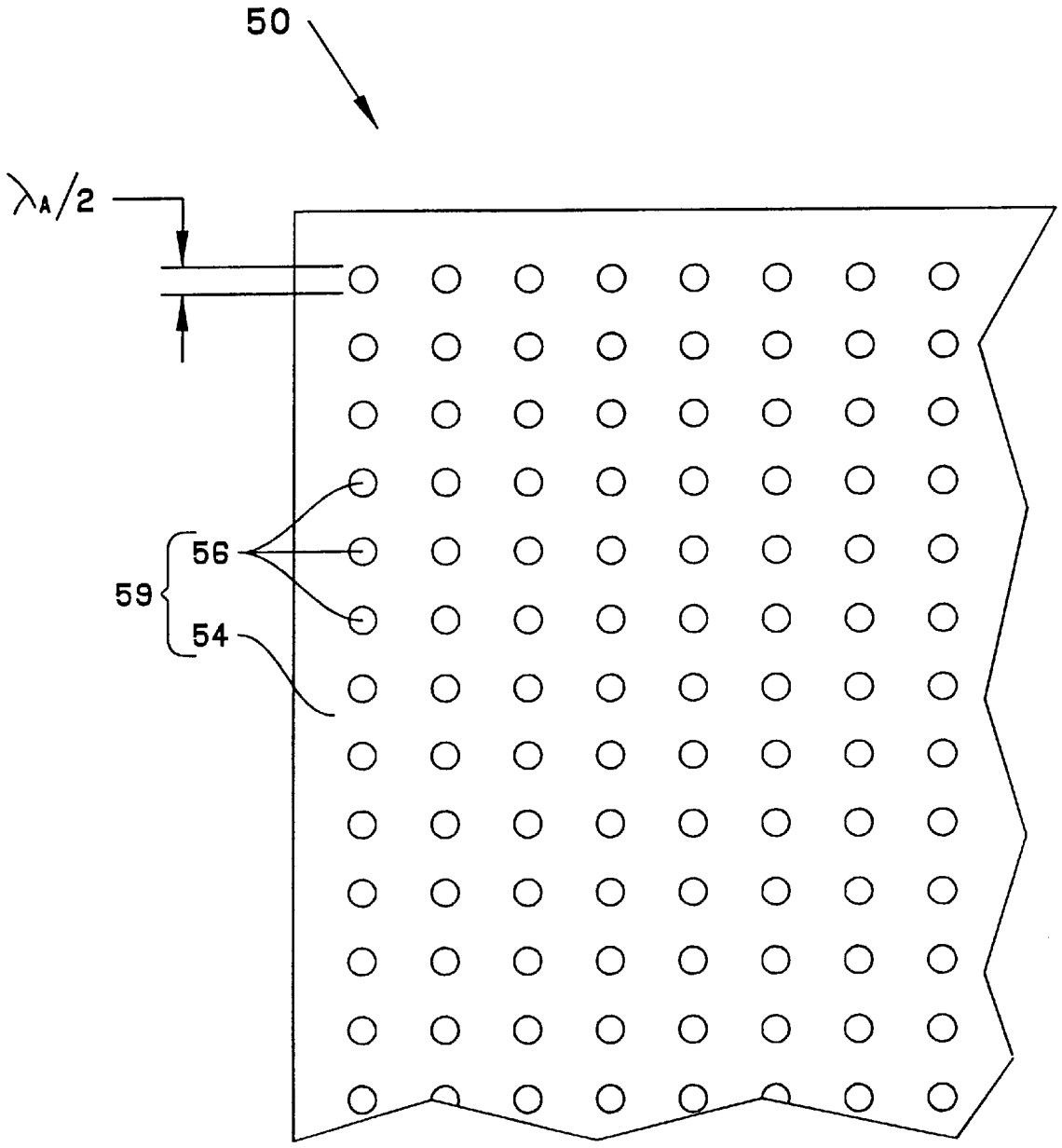
FIG. 5 shows circularly shaped apertures formed in a frequency selective surface.
Figure 6:
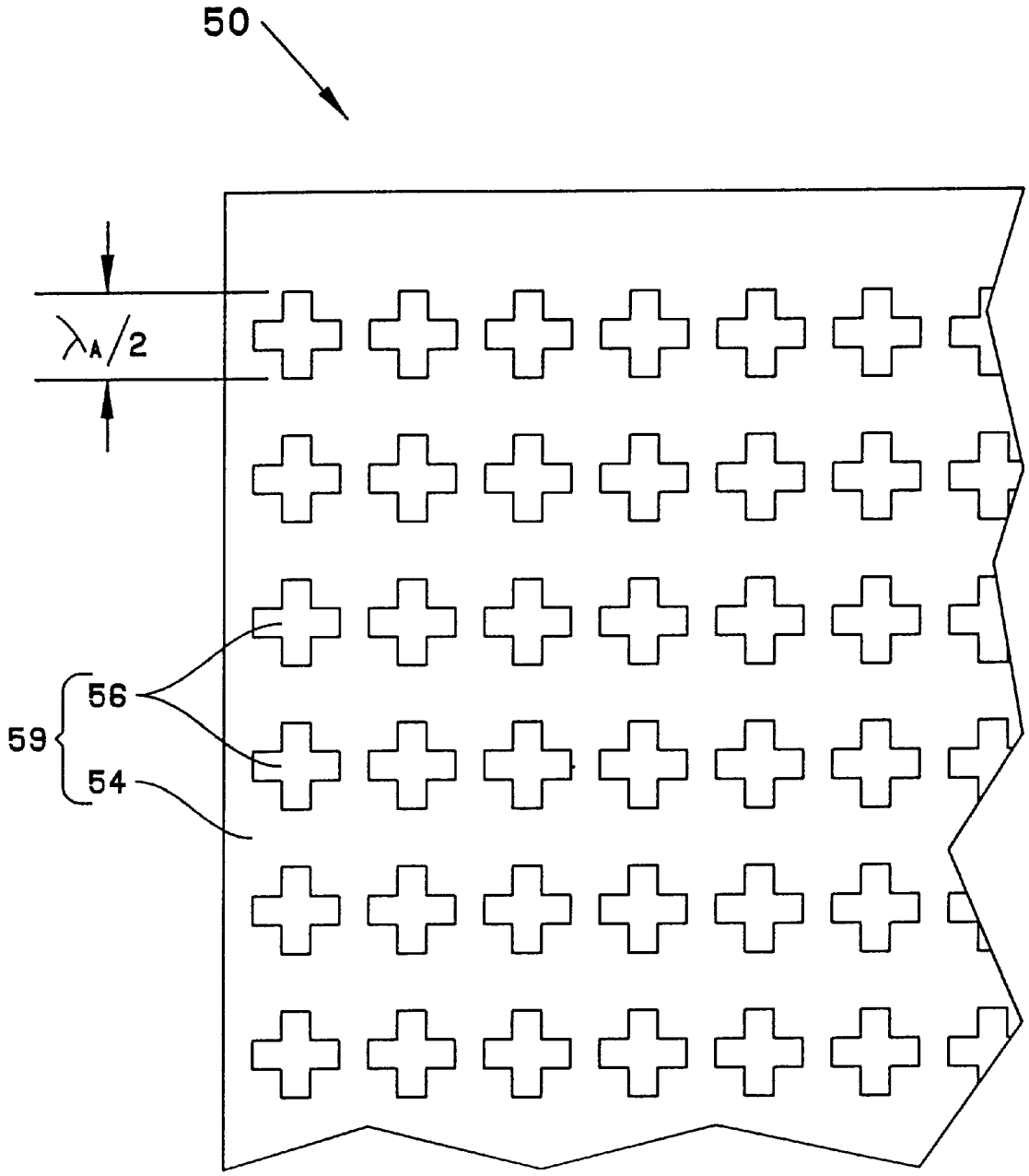
FIG. 6 shows cross-shaped apertures formed in a frequency selective surface.

The apertures may have various shapes. For example, FIG. 4 shows antenna 50 wherein the apertures 56 are implemented as Y-shaped slots formed in the conductive layer 54, where the length of each leg of the Y-shaped aperture 56 may be about $\lambda_A/4$. FIG. 5 shows antenna 50 wherein the apertures 56 are implemented as circular shaped slots formed in the conductive layer 54, where the diameter of the apertures may be about $\lambda_A/2$. FIG. 6 shows antenna 50 wherein the apertures 56 are implemented as crossshaped slots formed in the conductive layer 54, where the width and heights of the apertures may be about $\lambda_A/2$.

Figure 7:
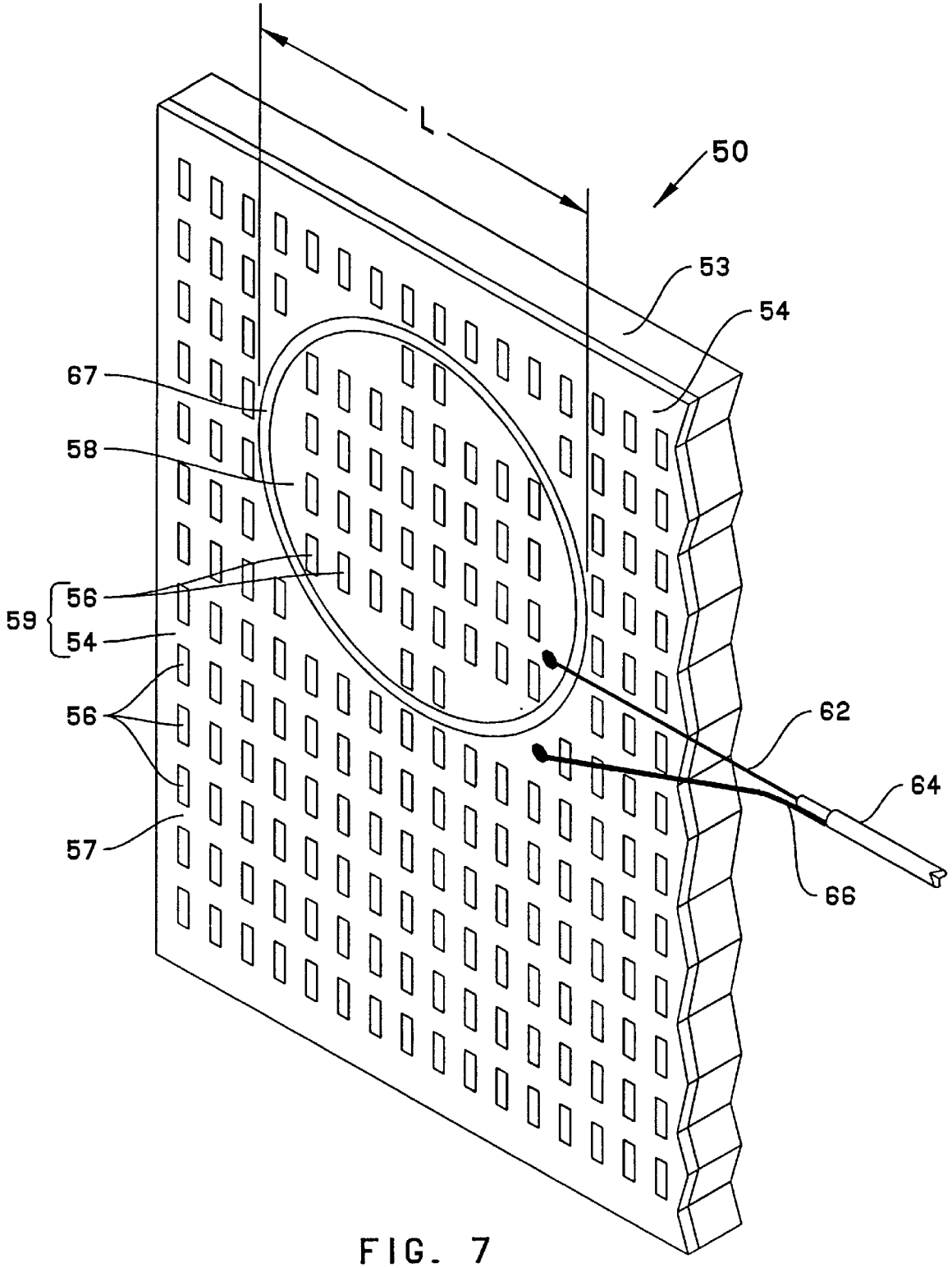
FIG. 7 shows a frequency selective surface integrated antenna system which includes a circularly shaped resonator.

FIG. 7 illustrates an embodiment of the (FSS) integrated antenna 50 which includes a generally circular shaped resonator 58 formed in FSS 59 defined by ring-shaped slotline 67. The resonator 58 may be fed by center conductor 62 of coaxial cable 64. The other ground plane region 57 of FSS 59 may be electrically connected to shielding 66 of the coaxial cable 64.

Figure 8:
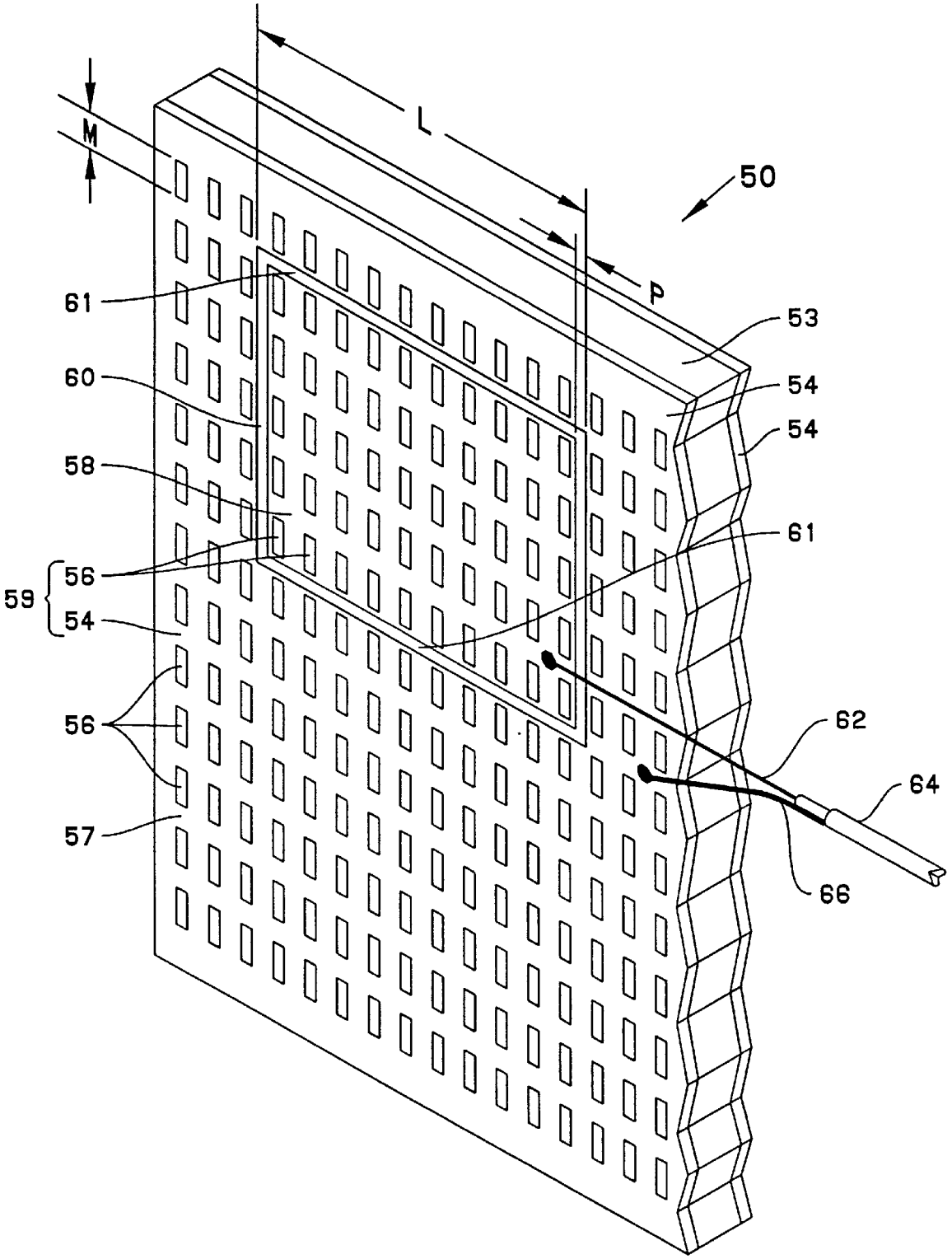
FIG. 8 shows a frequency selective surface integrated antenna system which includes electrically conductive layers formed on opposite sides of the electrically non-conductive layer.

Obviously, many modifications and variations of the present invention are possible in light of the above teachings. For example, two electrically conductive layers 54 may be formed on opposite sides of the electrically non-conductive layer 53, as shown in FIG. 8. Therefore, it is to be understood that within the scope of the appended claims, the invention may be practiced otherwise than as specifically described.

We claim:

1. A frequency selective surface integrated antenna, comprising:

a radio frequency selective surface including an electrically non-conductive substrate, and an electrically conductive layer mounted to said substrate and having a pattern of apertures;

a first slotline formed in said electrically conductive layer which divides said electrically conductive layer into a ground plane region and a first resonator region electrically isolated from said ground plane region; and a second slotline formed in said electrically conductive layer which defines a second resonator region electrically isolated from said ground plane region wherein said first and second resonator regions, and said ground plane region define a radio frequency bow-tie antenna integrated in said frequency selective surface.

2. A frequency selective surface integrated antenna, comprising:

a radio frequency selective surface including an electrically non-conductive substrate, and an electrically conductive layer mounted to said substrate and having a pattern of apertures;

a first slotline formed in said electrically conductive layer which divides said electrically conductive layer into said ground plane region and a first resonator region electrically isolated from said ground plane region; and a second slotline formed in said electrically conductive layer which defines a second resonator region electrically isolated from said ground plane region wherein said first and second resonator regions, and said ground plane region define a radio frequency dipole antenna integrated in said frequency selective surface.

3. A frequency selective surface integrated antenna, comprising:

an electrically non-conductive substrate having first and second opposed surfaces;

a first electrically conductive layer having a first pattern of apertures and mounted to said first opposed surface;

a second electrically conductive layer having a second pattern of apertures and mounted to said second opposed surface, said second electrically conductive layer being electrically isolated from said first electrically conductive layer; and a first slotline formed in said first electrically conductive layer which divides said first electrically conductive layer into a ground plane region and a resonator region electrically isolated from said ground plane region to define a radio frequency antenna integrated in said first electrically conductive layer.

* * * * *